US009416633B2

(12) United States Patent
O'Brien

(10) Patent No.: US 9,416,633 B2
(45) Date of Patent: Aug. 16, 2016

(54) SCREEN ASSEMBLY

(71) Applicant: Robert O'Brien, Katy, TX (US)

(72) Inventor: Robert O'Brien, Katy, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 237 days.

(21) Appl. No.: 13/873,431

(22) Filed: Apr. 30, 2013

(65) Prior Publication Data

US 2014/0318811 A1 Oct. 30, 2014

(51) Int. Cl.
*E21B 43/08* (2006.01)
*E21B 43/10* (2006.01)

(52) U.S. Cl.
CPC ..... *E21B 43/08* (2013.01); *E21B 43/10* (2013.01); *E21B 43/103* (2013.01)

(58) Field of Classification Search
CPC ..... E21B 43/08
See application file for complete search history.

(56) References Cited

U.S. PATENT DOCUMENTS

| | | | | |
|---|---|---|---|---|
| 2002/0053439 | A1* | 5/2002 | Danos | 166/380 |
| 2002/0174984 | A1* | 11/2002 | Jones | E21B 43/08 166/278 |
| 2006/0243454 | A1* | 11/2006 | Bolze et al. | 166/380 |
| 2009/0008084 | A1 | 1/2009 | Dybevik et al. | |
| 2011/0011586 | A1 | 1/2011 | Dusterhoft et al. | |
| 2011/0036565 | A1 | 2/2011 | Holderman et al. | |
| 2011/0042096 | A1 | 2/2011 | Nutley et al. | |
| 2011/0083860 | A1* | 4/2011 | Gano et al. | 166/386 |
| 2012/0227823 | A1 | 9/2012 | Veit | |
| 2013/0092394 | A1* | 4/2013 | Holderman et al. | 166/373 |

OTHER PUBLICATIONS

International Search Report and Written Opinion, Date of Mailing Jul. 14, 2014, International Appln No. PCT/US2014/031940, Korean Intellectual Property Office; International Search Report 6 pages; Written Opinion 8 pages.

Mohamed, Omar Y., et al. "One-Trip Installation of 4¾-in Expandable Screen Assembly", SPE/IADC 108262, SPE/IADC Middle East Drilling Technology Conference & Exhibition, Cairo, Egypt, Oct. 22-24, 2007, pp. 1-4.

* cited by examiner

*Primary Examiner* — Jennifer H Gay
*Assistant Examiner* — George Gray
(74) *Attorney, Agent, or Firm* — Cantor Colburn LLP

(57) ABSTRACT

A screen assembly including one or more screen members that correspondingly form one or more flow paths. The one or more flow paths are discrete from a tubular with which the one or more screen members are associated, but in fluid communication with an axial passageway of the tubular. A method of using a screen assembly is also included.

21 Claims, 2 Drawing Sheets

SCREEN ASSEMBLY

BACKGROUND

Screens and other filtering assemblies are ubiquitous in the downhole drilling and completions industry. These assemblies are primarily used to filter solids or particulate matter while enabling the production of fluids such as hydrocarbons. Due at least partially to their prevalence in the industry, advances and alternatives in downhole screen assemblies are always well received.

SUMMARY

A screen assembly, comprising one or more screen members that correspondingly form one or more flow paths, the one or more flow paths discrete from a tubular with which the one or more screen members are associated, but in fluid communication with an axial passageway of the tubular.

A screen assembly, comprising a plurality of screen members arranged at a same longitudinal position along a tubular, each of the screen members having a discrete closed shape that forms one of a plurality of discrete flow paths corresponding to the plurality of screen members.

A method of using a screen assembly, comprising positioning the screen assembly in a borehole, the screen assembly having one or more screen members discretely arranged with respect to a tubular having an axial passageway, the one or more screen members correspondingly forming one or more flow paths that are discrete from the tubular; and communicating fluid through the one or more screen members to the axial passageway via the one or more flow paths.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
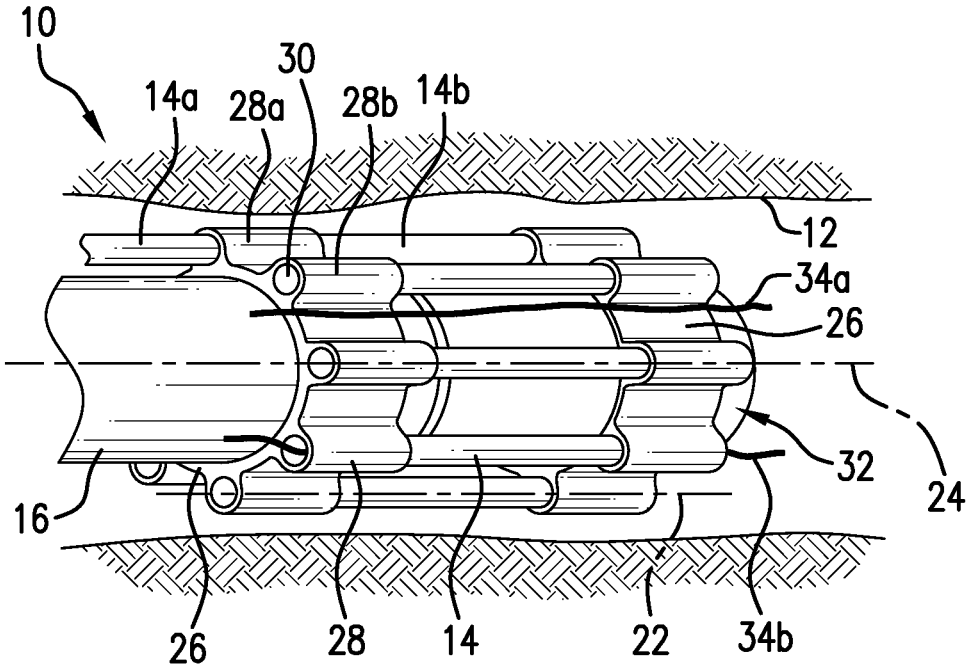
FIG. 1 illustrates a screen assembly installed in a borehole according to one embodiment disclosed herein.
Figure 2:
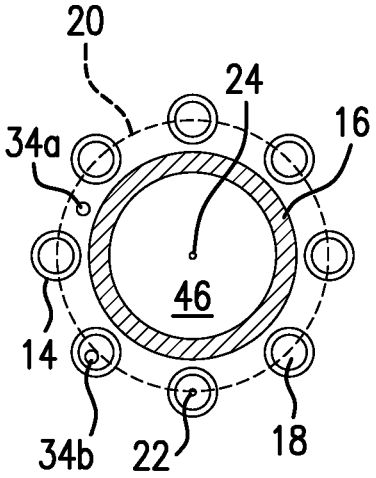
FIG. 2 is a cross-sectional view of the assembly of FIG. 1.

Referring now to FIGS. 1 and 2, a screen assembly 10 is illustrated for filtering solids or particulates while enabling the production of desired fluids, e.g., of hydrocarbons, from a subterranean formation via a borehole 12. It is to be appreciated at the outset that for succinctness in discussion the assembly 10 is illustrated as a conglomeration of embodiments including several features that may be used separately or together in any combination. In general, the screen assembly 10 includes one or more discrete screen members 14 arranged circumferentially about a tubular of a tubular string 16, which is, e.g., a production string. By tubular string it is meant one or more tubulars disposed together. The screen members 14 include a filter portion, which can be any desired filtering material, medium, or configuration, such as mesh, slots, wire-wrap, permeable foam, or combinations thereof. In one embodiment, the filtering material is wrapped or disposed about a perforated inner tubular or mini-base pipe to form the screen members 14. It is to of course be appreciated that in other embodiments the screen members 14 can be formed solely from a filter material without use of an inner tubular. The tubular string 16 includes one or more ports or openings (discussed in more detail below) or is otherwise in fluid communication with the screen members 14 for enabling production of fluids filtered by the screen assembly 10.

It is evident to those of ordinary skill in the art from even a cursory review of the drawings that the screen assembly 10 differs from traditional screens, in which a filter is concentrically wrapped at least partially about a base pipe or other tubular to form a radial flow gap bounded between the screen and the tubular about which the screen is wrapped. Instead of this traditional arrangement, the screen members 14 are arranged as discrete members that form discrete flow paths therein. By "discrete" it is meant that the screen members 14 each form a closed shape defining a flow path 18 therein that is separate from the other screen members 14 and from the tubular string 16. It is noted that a pattern formed by all of the screen members 14 may encircle the tubular string 16, but that the tubular string 16 is not enclosed within any individual one of the screen members 14. In this way, the flow paths 18 are discrete from and not defined by the tubular string 16. For example, the screen members 14 in FIG. 2 are shown in a circular pattern, designated by a dashed line 20, surrounding the tubular string 16, but the tubular string 16 is not enclosed by any individual one of the screen members 14. Of course, screen members in other embodiments could be arranged according to other patterns. It is additionally to be recognized that the screen assembly 10 differs from traditional screens in that it includes a plurality of the discrete screen members 14 at a same longitudinal or axial position within the borehole 12 and/or along the length of the string 16.

Additionally, by being discrete members, each of the screen members 14 in the illustrated embodiment, and correspondingly each of the flow paths 18, is offset or nonconcentric with respect to the tubular string 16. It is also noted that despite the screen members 14 and the associated flow paths 18 each being nonconcentric with the tubular string 16, the pattern formed by discretely positioning the screen members 14 about the tubular string 16, may be concentric with respect to the tubular string 16. That is, for example, the pattern 20 in FIG. 2 is circumferentially and concentrically positioned about the tubular string 16, while the axes of each of the screen members 14, e.g., an axis 22 of an exemplary one of the screen members 14, are each offset from an axis 24 of the tubular string 16.

The screen members 14 are coupled to the tubular string 16 via couplings 26, which have receptacles 28 configured to receive the screen members 14. The screen members 14 are engagable with the receptacles 28 via threads, ratcheting, grooves, force fitting, welds, etc., or in any other suitable manner. In one embodiment, the receptacles 28 are open on both ends for connecting adjacent ones of the screen members 14, while in other embodiments the receptacles 28 are capped off opposite to their securement with the screen members 14. For example, a representative one of the receptacles 28, designated with the numeral 28*a*, is secured at one end to a first representative one of the screen members 14, designated with the numeral 14*a*, and at the opposite end to a second representative one of the screen members, designated with the numeral 14*b*. Another representative one of the receptacles 28, designated with the numeral 28*b*, has a capped end 30 for sealing off the flow path 18 through the receptacle 28*b*.

The screen members 14 can be arranged to create a gap 32 between each circumferentially adjacent pair of the screen members 14. In one embodiment, the gaps 32 provide fluid about the screen members 14. Traditional screens are typically spaced some minimum distance from the borehole wall in order to provide sufficient fluid flow into the screen, e.g., during production, and about the screen, e.g., during gravel packing, fracturing, or other borehole treatments or stimulations. Accordingly, in one embodiment, the fluid flow provided by the gaps 32 enables the screen members 14 to be positioned relatively closer to the borehole 12 than a traditional screen could be positioned, thereby enabling the borehole 12 to be more efficiently drilled with a smaller diameter. In another embodiment, the gaps 32 provide for the flow of fluid (e.g., proppant, slurry, injected chemicals, acid, etc.) past, around, or about the screen assembly 10, e.g., for gravel or frac packing, fracturing, or other treatment or stimulation operations.

Additionally, as shown in FIGS. 1 and 2, the gaps 32 can be utilized to house and/or protect a control line, cable, instrumentation line, etc. (generally "control line"). The control line can be a hydraulic control line, fiber optic cable, electrical signal conductor, etc., arranged for enabling signal and/or power communication to and/or from the downhole environment. For example, a control line 34*a* is shown located in one of the gaps 32 between an adjacent pair of the screen members 14 in FIGS. 1 and 2. The line 34*a* is generally maintained and protected within its corresponding one of the gaps 32 during run-in, completion, and production. Even though the line 34*a* is generally protected, it remains open to downhole fluids, thereby enabling borehole fluids and downhole operations to be monitored by the line 34*a* and/or via sensors attached thereto, if desired. As another example, a control line 34*b* is illustrated passing through one of the screen members 14, thereby providing protection to the control line 34*b*. A clip, adhesive, fastener, or other device or mechanism could be used for holding the control lines 34*a* and/or 34*b* in their respective areas.

It is also to be appreciated that the gaps 32 could be used for holding or providing for a shunt tube or other tool or piece of equipment to be located and/or passed by the screen assembly 10. Furthermore, ones of the screen members 14 could be used as shunt tubes to enable the conveyance of proppant, gravel, or slurry downhole. In one embodiment, one or more of the screen members 14 is replaced by a similarly shaped and sized blank tubular (e.g., not including a filtering material, perforations, or other openings in its circumferential surface) that is receivable in the receptacles 28 of the couplings 26 (the blank tube generally resembling any one of the screen members 14 and thus sufficiently represented in the drawings, although it is understood that the blank tube or shunt tube could take other forms). For example, in one embodiment, the blank tubular is used as a shunt tube to convey slurry or proppant to the borehole 12 or as a protective conduit for housing control lines, sensors, or other equipment. For example, in one embodiment, the screen assembly 10 is modified such that seven of the screen members 14 are included as described above, while an eighth is replaced by a section of blank pipe for protecting control lines, enabling slurry or other media to be conveyed downhole, etc.

Figure 3:
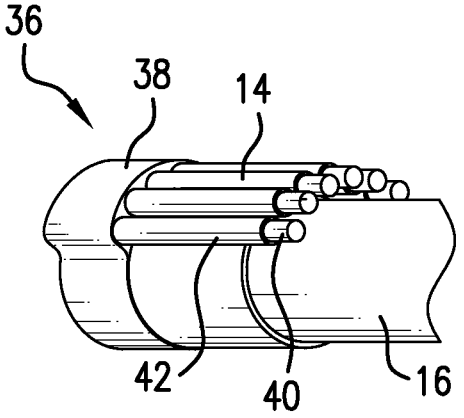
FIG. 3 illustrates a screen assembly according to one embodiment disclosed herein.

The screen members 14 of the embodiment of FIGS. 1 and 2 are shown having a circular cross-section. It is to of course be appreciated that the screen members 14 could take any other desired shape, e.g., polygonal, irregular, crescent or kidney-bean (e.g., to follow the contours of the tubular string 16), etc. It is also to be appreciated that the screen members 14 can be arranged in any desired pattern about the tubular string 16 and that they do not need to follow the circular pattern 20. Moreover, size of the gaps 32 and/or spacing between the screen members 14 does not need to be consistent. For example, the screen members 14 in FIGS. 1 and 2 are evenly, symmetrically, and/or regularly spaced about the circumference of the tubular string 16. In other embodiments, the spacing between adjacent ones of the screen members 14 could be irregular or inconsistent. In some embodiments the pattern formed by the screen members 14 is asymmetrical, i.e., the screen members 14 wrap around only a portion of the circumference of the tubular string 16, e.g., an assembly 36 in FIG. 3 discussed below. The pattern formed by the members 14 can be concentrically or eccentrically included about the tubular string 16.

As noted above, the screen assembly 36 includes the screen members 14 arranged in an asymmetric pattern about the tubular string 16. By this it is meant that the screen members 14 of the assembly 36 are not evenly spaced and positioned about the tubular string 16, but instead are grouped together at one side of the tubular string 16. A coupling 38 is included for securing the screen members 14 of the assembly 36 to the string 16. The ends of the screen members 14 opposite from the coupling 38 are illustrated as being open, although it is to be appreciated that these ends would be connected into another coupling or screen member, capped off, etc. Additionally, the ends of the screen members 14 are shown tapered or having reduced diameter than the body of the screen members 14, which can assist in securing the screen members 14 in the receptacles of the couplings 26 and/or 38. The tapered ends may be caused by the aforementioned inner tubulars or base pipes of the screen members 14, e.g., a base pipe 40, extending out from a filter portion 42 wrapped thereon. It is to of course be appreciated that the description of the assembly is generally application to those of the assembly 10 and that components and features of the assembly 36 can be used with or for the assembly 10, and vice versa.

Figure 4:
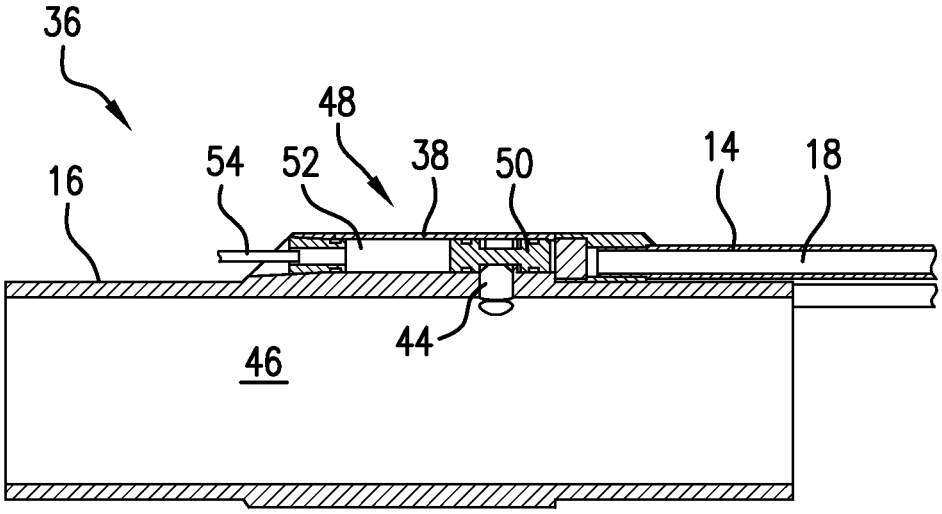
FIG. 4 is a cross-sectional view of the assembly of FIG. 3.

As shown in cross-section in FIG. 4, the coupling 38 is positioned with respect to one or more ports or openings 44 in the tubular string 16, thereby providing fluid communication between the flow paths 18 and an axial passage 46 of the string 16. The coupling 38 also includes a valve 48 having a valve member 50 that is movable within a valve chamber 52 in order to selectively enable fluid communication between the flow paths 18 and the axial passageway 46. In the illustrated embodiment, the valve member 50 is controlled hydraulically via a control line 54 in fluid communication with the chamber 52. That is, pressure can be communicated via the control line 54 to hold the valve member 50 in the closed configuration shown in FIG. 4. Upon relieving the pressure in the control line 54, pressure from the downhole fluid entering the flow paths 18 through the screen members 14 will force the member 50 toward the line 54, uncovering or opening the ports 44 and enabling production of the fluid through the axial passageway 46 of the string 16. It is to be appreciated that the chamber 52 and the valve member 50 can be in communication with all of the screen members 14 of the assembly 36 (e.g., the member 50 resembling a sliding sleeve or arcuate member), selected ones or groups of the screen members 14, or each of the screen members 14 could be provided separately with a valve member (e.g., the member 50 being generally cylindrical in shape). It is additionally to be appreciated that a valve member, e.g., a sliding sleeve, can be positioned within the axial passage 46 in order to selectively enable fluid communication. Additionally, the valve member 50 or any other valve member can be actuated mechanically, e.g., via a shifting tool or spring, electrically, e.g., via a motor or electromagnet, or in any other manner known in the art or otherwise. In one embodiment, a sliding sleeve having a seat is provided to receive a ball or plug dropped downhole and shifted by pressuring against the plug and seat in order to selectively open the ports 44.

Figure 5:
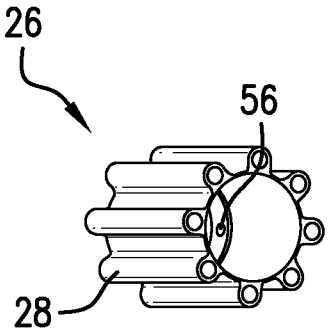
FIG. 5 illustrates a coupling of the screen assembly of FIG. 1.

FIG. 5 shows one of the couplings 26 without the rest of the screen assembly 10. From the view of FIG. 5 it can be appreciated that one or more ports 56 in the couplings 26 can be positioned with respect to ports, e.g., the ports 44, in the string 16, similar to the coupling 38 in order to enable fluid communication between the flow paths 18 and the axial passageway 46. Additionally, a valve, for example, any of the valves discussed above with respect to the assembly 36, could be arranged with the coupling 26 to selectively enable fluid communication through the screen assembly 10. One of the ports 56 could be provided for each of the screen members 14, or multiple ones of the screen members 14 could be in fluid communication with single ones of the ports 56 via grooves or the like within the coupling 26.

Figure 6:
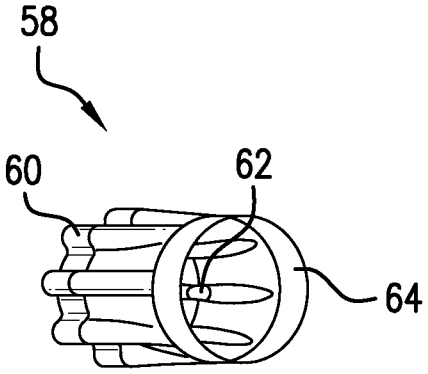
FIG. 6 is a coupling for a screen assembly according to one embodiment disclosed herein.

FIG. 6 illustrates a coupling 58 that also enables fluid communication between the flow paths 18 of the screen members 14 and the axial passageway 46 of the string 16. Specifically, the coupling 58 includes receptacles 60 adapted to receive the screen members 14 and that terminate in ports 62. The coupling 58 can be secured between two sections of the string 16, e.g., at an end 64 (and an opposite end, hidden from view behind the receptacles 60), such that the ports 62 open directly into axial passageway 46 of the string 16. The end 64 could be threaded, force fit, welded, or secured to the string 16 in some other manner. Alternatively, the ports 62 could be aligned with ports in the string 16, e.g., resembling the ports 44.

With knowledge that the filterable surface area of a cylindrical screen is measured as pi times diameter times length, the total filterable surface area of the screen members 14 of the assembly 10 can be set to equal or approximate that of a traditional screen of a given length by modifying the number and diameter of the screen members 14. For example, there are eight of the screen members 14 in the illustrated embodiments, thus, by setting the diameter of each of the screen members 14 to be one-eighth that of a traditional screen, the total filterable surface area of the screen assembly 10 would approximate that of the tradition screen, assuming constant length. In this way, for example, eight of the screen members 14, each having a one inch diameter, would approximate the same total filterable surface area as a traditional screen eight inches in diameter having the same length. Of course, any other number of the screen members 14 and/or diameters of the screen members 14 could be utilized and the size of screen members in the same assembly could also vary.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A screen assembly, comprising:

one or more screen members that correspondingly form one or more flow paths, the one or more flow paths discrete from a tubular with which the one or more screen members are associated, but in fluid communication with an axial passageway of the tubular, the fluid communication provided by one or more ports in the tubular, the one or more screen members being spaced from the tubular to define a flow area between the one or more screen members and the tubular such that fluid may enter the one or more screen members from 360 degrees about the one or more screen members;

one or more couplings disposed radially outwardly of the tubular;

one or more receptacles supported by the one or more couplings, the one or more receptacles being spaced radially outwardly of the tubular;

one or more of the one or more receptacles supporting an end of the one or more screen members; and, one or more valves selectively enabling the fluid communication between the one or more screen members and the tubular.

2. The screen assembly of claim 1, wherein the one or more screen members includes a plurality of screen members arranged in a symmetric pattern about the tubular.

3. The screen assembly of claim 1, wherein the one or more screen members includes a plurality of screen members arranged in an asymmetric pattern about the tubular.

4. The screen assembly of claim 1, wherein the one or more valves are hydraulically actuated.

5. The screen assembly of claim 1, further comprising one or more couplings configured for mounting the one or more screen members to the tubular.

6. The screen assembly of claim 5, wherein the one or more couplings includes one or more receptacles corresponding to and separately receiving each of the one or more screen members.

7. The screen assembly of claim 6, further comprising a blank tube, wherein the one or more receptacles includes a plurality of receptacles at least one of which receives the blank tube.

8. The screen assembly of claim 7, wherein the blank tube is a shunt tube.

9. The screen assembly of claim 5, wherein the one or more couplings includes a port opening into the axial passageway of the tubular.

10. The screen assembly of claim 1, further comprising a control line.

11. The screen assembly of claim 10, wherein the control line is located in at least one of one or more gaps located adjacent to the one or more screen members.

12. The screen assembly of claim 1, wherein the one or more screen members includes a base pipe surrounded by a filter portion.

13. The screen assembly of claim 1, wherein the screen assembly is positioned within a borehole for enabling the production of fluids from the borehole.

14. A screen assembly comprising:

one or more screen members that correspondingly form one or more flow paths, the one or more flow paths discrete from a tubular with which the one or more screen members are associated, but in fluid communication with an axial passageway of the tubular, the one or more screen members being spaced from the tubular to define a flow area between the one or more screen members and the tubular such that fluid may enter the one or more screen members from 360 degrees about the one or more screen members;

one or more couplings disposed radially outwardly of the tubular;

one or more receptacles supported by the one or more couplings, the one or more receptacles being spaced radially outwardly of the tubular;

one or more of the one or more receptacles supporting an end of the one or more screen members; and, a control line, wherein the control line is located through at least one of the one or more screen members.

15. A screen assembly, comprising:

a plurality of screen members arranged at a same longitudinal position along a tubular, the plurality of screen members in fluid communication with an axial passageway of the tubular, the fluid communication provided by one or more ports in the tubular, each of the screen members having a discrete closed shape that forms one of a plurality of discrete flow paths corresponding to the plurality of screen members, each of the plurality of screen members being radially spaced from the tubular to define a flow area between each of the members and the tubular, the assembly further including one or more couplings disposed radially outwardly of the tubular;

one or more receptacles supported by the one or more couplings, the one or more receptacles being spaced radially outwardly of the tubular;

one or more of the one or more receptacles supporting an end of the one or more screen members; and, one or more valves selectively enabling the fluid communication between the one or more screen members and the tubular;

wherein the one or more receptacles fully surround and encompass the end of the one or more screen members, respectively.

16. A method of using a screen assembly, comprising:

positioning the screen assembly in a borehole, the screen assembly having one or more screen members discretely arranged with respect to a tubular having an axial passageway, the one or more screen members correspondingly forming one or more flow paths that are discrete from the tubular, the one or more screen members being spaced from the tubular to define a flow area between the one or more screen members and the tubular, the assembly further including one or more couplings disposed radially outwardly of the tubular, one or more receptacles supported by the one or more couplings, the one or more receptacles being spaced radially outwardly of the tubular;

supporting the one or more screen members by one or more of the one or more receptacles;

passing fluid from the flow area into the one or more flow paths of the one or more screen members; and, communicating the fluid from the one or more flow paths of the one or more screen members into the axial passageway through one or more ports in the tubular;

wherein the communicating includes selectively opening one or more valves disposed between the one or more flow paths and the axial passageway of the tubular.

17. The method of claim 16, wherein the communicating includes gravel packing, frac packing, hydraulic fracturing, stimulation of the borehole, treatment of the borehole, or a combination including at least one of the foregoing.

18. The method of claim 16, further comprising passing fluid from an area surrounding substantially an entire outer periphery of the one or more screen members into the one or more flow paths of the one or more screen members.

19. A screen assembly, comprising:

one or more screen members that correspondingly form one or more flow paths, the one or more flow paths discrete from a tubular with which the one or more screen members are associated, but in fluid communication with an axial passageway of the tubular, the fluid communication provided by one or more ports in the tubular, the one or more screen members being spaced from the tubular to define a flow area between the one or more screen members and the tubular;

one or more couplings disposed radially outwardly of the tubular;

one or more receptacles supported by the one or more couplings, the one or more receptacles being spaced radially outwardly of the tubular;

one or more of the one or more receptacles supporting the one or more screen members; and, one or more valves selectively enabling the fluid communication between the one or more screen members and the tubular;

wherein the one or more screen members are suspended in a spaced relationship exterior of the tubular by the one or more receptacles, and the one or more screen members are in fluid communication with the flow area between the one or more screen members and the tubular.

20. A screen assembly, comprising:

one or more screen members that correspondingly form one or more flow paths, the one or more flow paths discrete from a tubular with which the one or more screen members are associated, but in fluid communication with an axial passageway of the tubular, the fluid communication provided by one or more ports in the tubular;

one or more couplings disposed radially outwardly of the tubular;

one or more receptacles supported by the one or more couplings, the one or more receptacles being spaced radially outwardly of the tubular;

one or more of the one or more receptacles supporting the one or more screen members; and, one or more valves selectively enabling the fluid communication between the one or more screen members and the tubular;

wherein the one or more couplings and the one or more receptacles fix the one or more screen members radially with respect to a longitudinal axis of the tubular, and the one or more screen members are non-extendable in a radial direction with respect to the tubular.

21. The screen assembly of claim 20, wherein the one or more screen members are in fluid communication with a flow area between the one or more screen members and the tubular member.

* * * * *